US011336062B2

(12) United States Patent
Jie

(10) Patent No.: US 11,336,062 B2
(45) Date of Patent: May 17, 2022

(54) ILLUMINATED POWER STRIP ASSEMBLY

(71) Applicant: Lumi Legend Electrical Co. LTD, Ningbo (CN)

(72) Inventor: Xu Jie, Ningbo (CN)

( * ) Notice: Subject to any disclaimer, the term of this patent is extended or adjusted under 35 U.S.C. 154(b) by 380 days.

(21) Appl. No.: 16/597,190

(22) Filed: Oct. 9, 2019

(65) Prior Publication Data

US 2021/0111524 A1 Apr. 15, 2021

(51) Int. Cl.
*H01R 13/717* (2006.01)
*H01R 25/00* (2006.01)

(52) U.S. Cl.
CPC ..... *H01R 13/717* (2013.01); *H01R 25/003* (2013.01)

(58) Field of Classification Search
None
See application file for complete search history.

(56) References Cited

U.S. PATENT DOCUMENTS

| | | | | |
|---|---|---|---|---|
| 4,000,405 | A | 12/1976 | Horwinski | |
| 7,011,422 | B2 * | 3/2006 | Robertson | F21V 33/006 200/310 |
| 7,635,273 | B2 | 12/2009 | Buzil | |
| 7,651,365 | B2 | 1/2010 | Chien | |
| 7,661,850 | B2 | 2/2010 | Hsu | |
| 9,991,654 | B1 | 6/2018 | DePhillips | |
| 10,323,835 | B1 | 6/2019 | Anderson | |
| 10,337,719 | B2 | 7/2019 | Chien | |
| 2005/0124209 | A1 * | 6/2005 | Currie | H01R 13/7172 439/490 |
| 2017/0104299 | A1 * | 4/2017 | Vu | H01R 24/78 |
| 2018/0006412 | A1 | 1/2018 | Leaverton | |

* cited by examiner

*Primary Examiner* — Cassandra F Cox

(57) ABSTRACT

An illuminated power strip assembly includes a housing with a top wall having opaque areas and translucent areas. A plurality of power outlets is mounted in the housing. A power cord extends outwardly from the housing and terminates with a male power plug. A power switch is mounted on the housing and is in electrical communication with the power outlets. A plurality of light emitters is mounted in the interior space and is in electrical communication with the power switch. The light emitters selectively emit different colors to be emitted through the translucent areas. A control circuit is electrically coupled to the light emitters and is actuated to select a color emitted by the light emitters.

15 Claims, 5 Drawing Sheets

ILLUMINATED POWER STRIP ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to a power strip device and more particularly pertains to a new power strip device which can be illuminated and its color altered so that it matches other gaming equipment used with a gaming system.

(2) Description of Related Art Including Information Disclosed Under 37 CFR 1.97 and 1.98

The prior art relates to power strip devices which are used for powering a plurality of electronic device simultaneously.

BRIEF SUMMARY OF THE INVENTION

An embodiment of the disclosure meets the needs presented above by generally comprising a housing with a top wall having opaque areas and translucent areas. A plurality of power outlets is mounted in the housing. A power cord extends outwardly from the housing and terminates with a male power plug. A power switch is mounted on the housing and is in electrical communication with the power outlets. A plurality of light emitters is mounted in the interior space and is in electrical communication with the power switch. The light emitters selectively emit different colors to be emitted through the translucent areas. A control circuit is electrically coupled to the light emitters and is actuated to select a color emitted by the light emitters.

In one aspect, an embodiment includes a housing that has a bottom wall, a top wall and a perimeter wall is attached to and extends between the top and bottom walls. The top wall has opaque areas and translucent areas such that light from an interior space of the housing is transmittable through the translucent areas. A plurality of power outlets is mounted in the interior space of the housing. The top wall has a plurality of sets of apertures extending therethrough. Each of the apertures is aligned with one of the power outlets such that each of the power outlets is accessible through the top wall. A power cord extends outwardly from the housing and terminates with a male power plug. A power switch is mounted on the housing and is in electrical communication with the power outlets. A plurality of light emitters is mounted in the interior space and is in electrical communication with the power switch. The light emitters include multi-color light emitters. Each of the light emitters is configured to selectively emit at least three different colors. A control circuit is electrically coupled to the light emitters and is actuated to select a color emitted by the light emitters.

In another aspect, the embodiment includes a housing has a bottom wall, a top wall and a perimeter wall that is attached to and extends between the top and bottom walls. The top wall has opaque areas and translucent areas such that light from an interior space of the housing is transmittable through the translucent areas. A plurality of power outlets is mounted in the interior space of the housing. The top wall has a plurality of sets of apertures extending therethrough. Each of the apertures is aligned with one of the power outlets such that each of the power outlets is accessible through the top wall. A power cord extends outwardly from the housing and terminating with a male power plug. A power switch is mounted on the housing and is in electrical communication with the power outlets. A plurality of light emitters is mounted in the interior space and is in electrical communication with the power switch. The light emitters are configured to selectively produce one of a plurality of colors to be transmitted through the translucent areas. The plurality of colors includes at least three different colors. A control circuit is electrically coupled to the light emitters and is actuated to select a color emitted by the light emitters.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
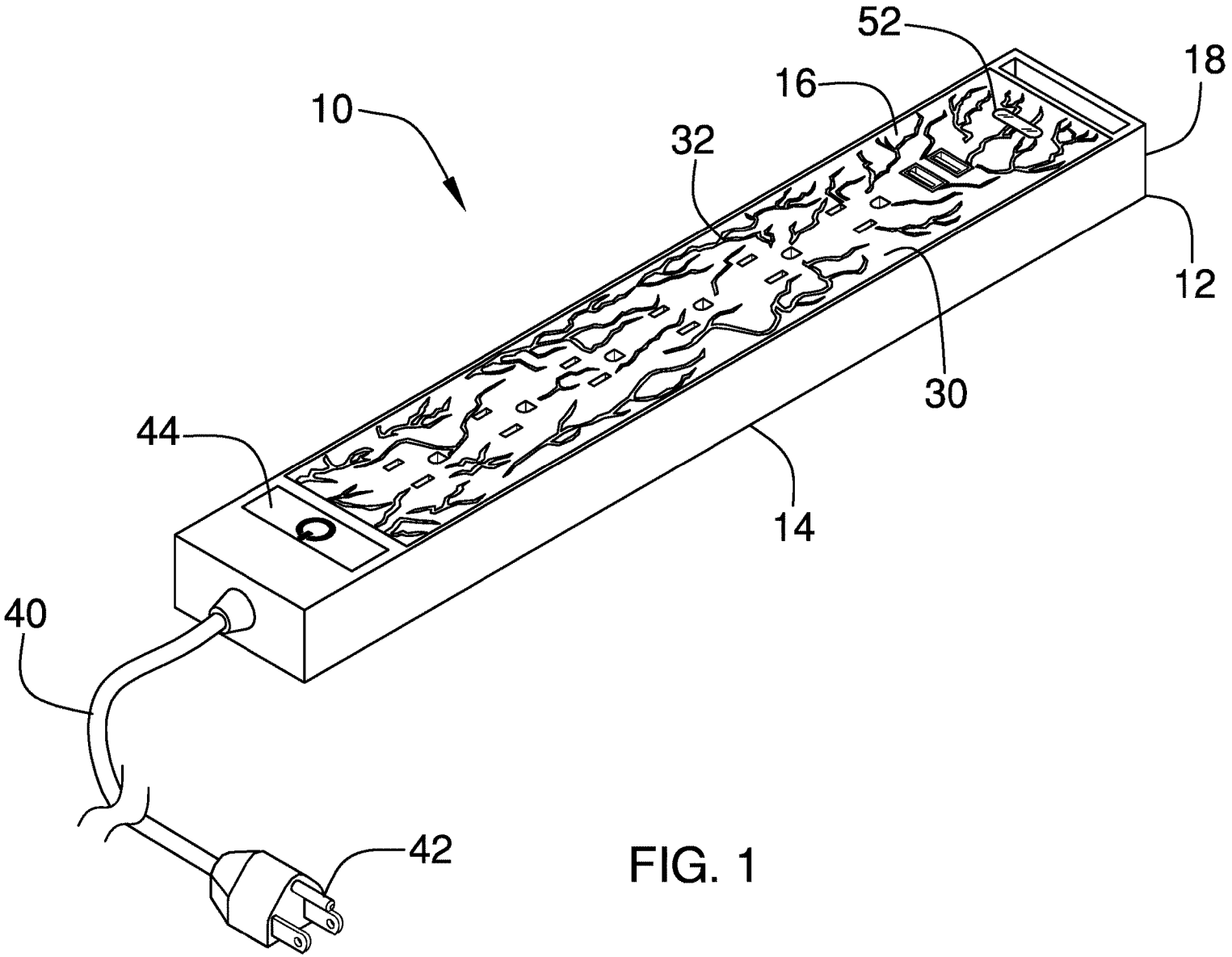
FIG. 1 is a top isometric view of a illuminated power strip assembly according to an embodiment of the disclosure.
Figure 2:
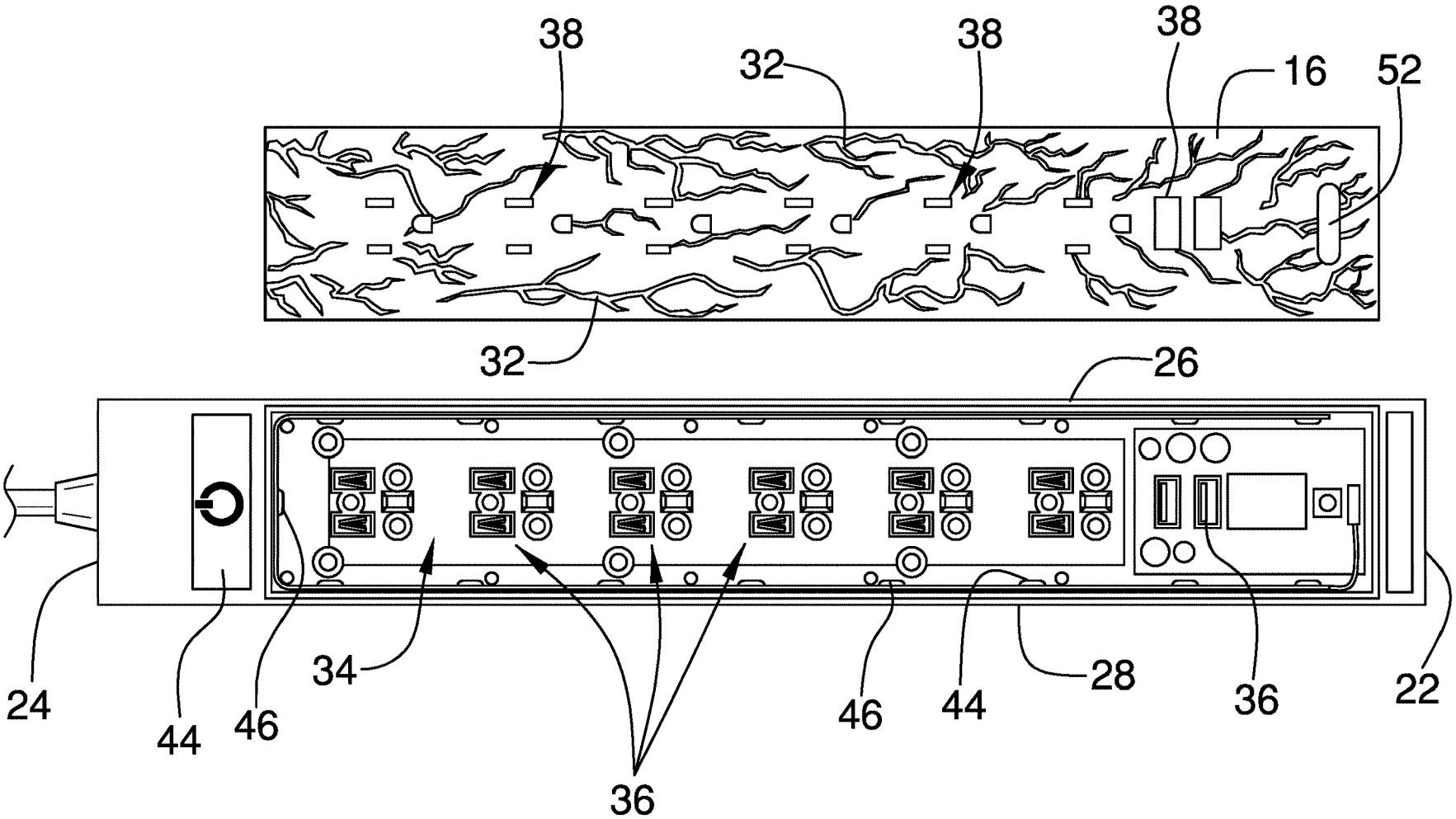
FIG. 2 is a top view of an embodiment of the disclosure.
Figure 3:
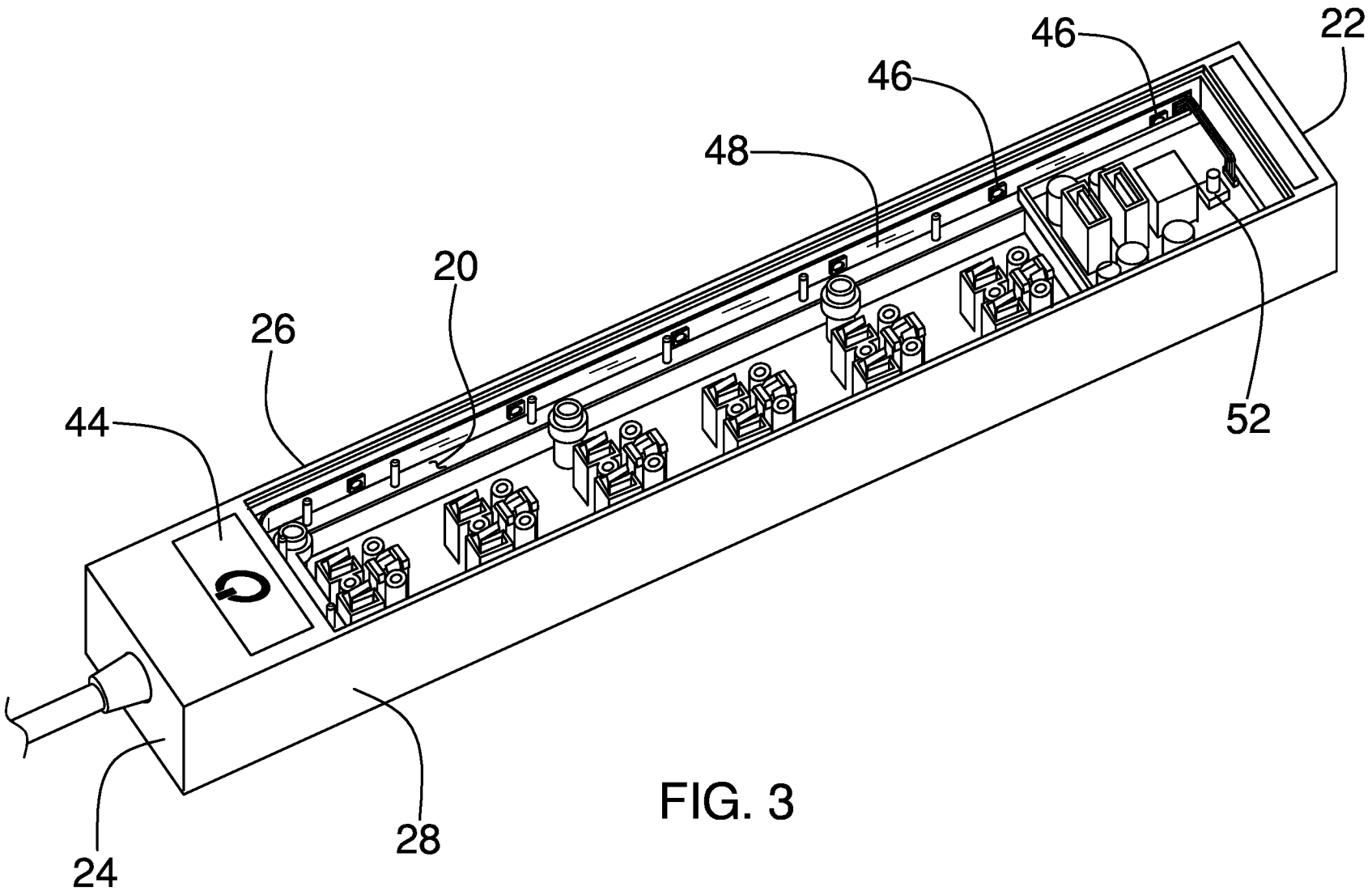
FIG. 3 is a top isometric view of an embodiment of the disclosure.
Figure 4:
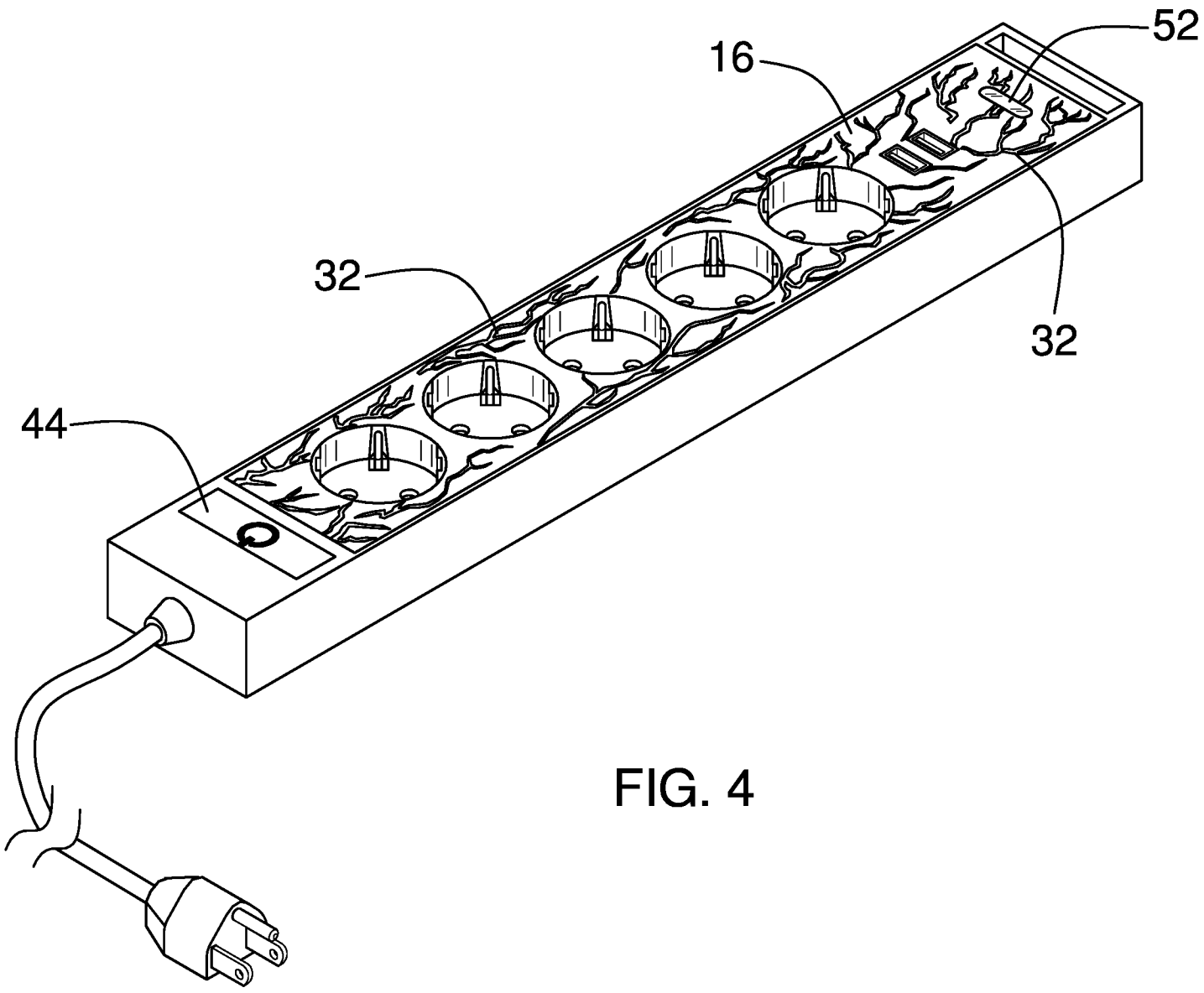
FIG. 4 is a top isometric view of an embodiment of the disclosure.
Figure 5:
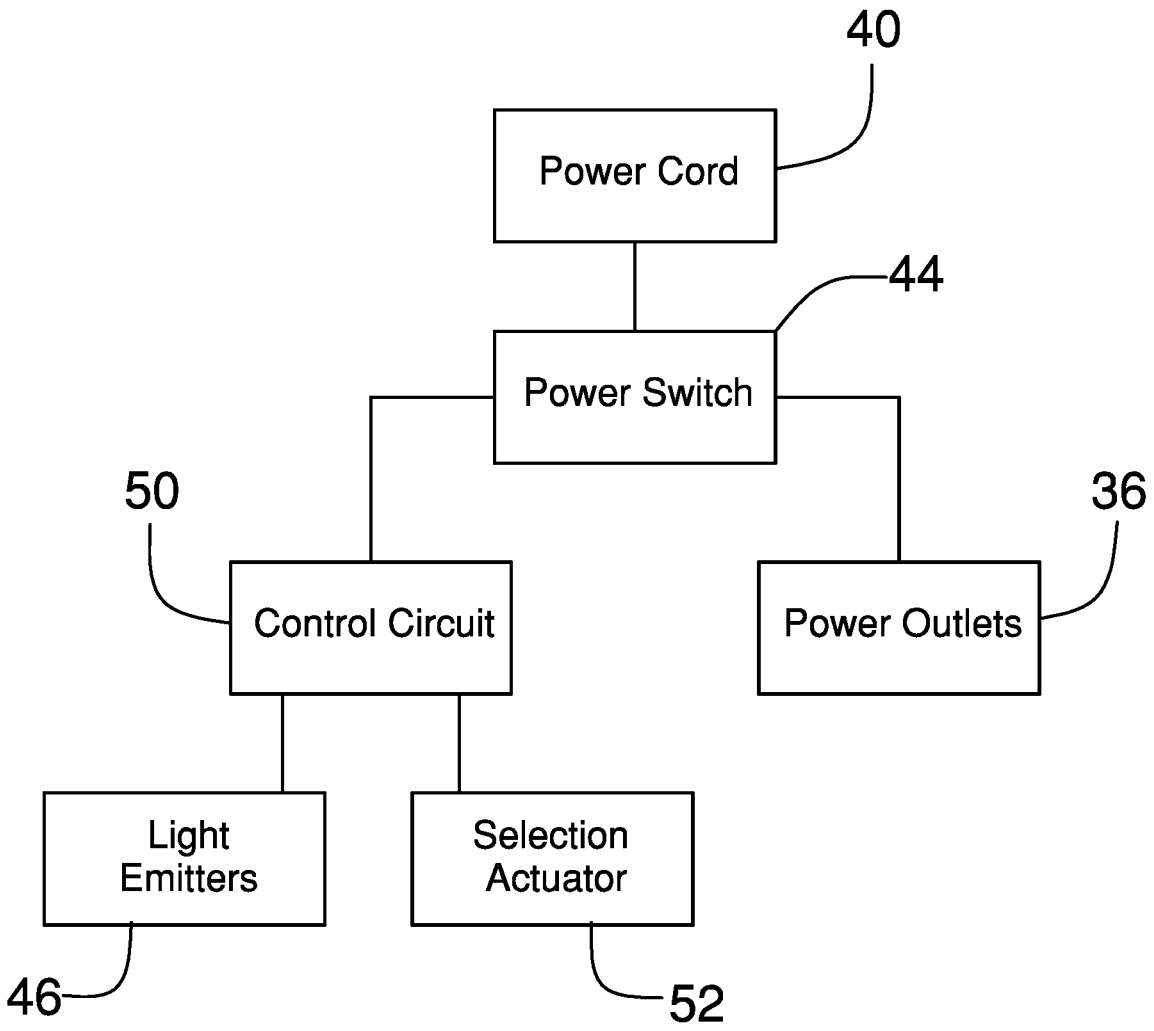
FIG. 5 is a schematic view of an embodiment of the disclosure.

With reference now to the drawings, and in particular to FIGS. 1 through 5 thereof, a new power strip device embodying the principles and concepts of an embodiment of the disclosure and generally designated by the reference numeral 10 will be described.

As best illustrated in FIGS. 1 through 5, the illuminated power strip assembly 10 generally comprises a housing 12 that has a bottom wall 14, a top wall 16 and a perimeter wall 18 that is attached to and extends between the top 16 and bottom 14 walls. The perimeter wall 18 has an interior surface 20 facing an area bounded by the perimeter wall 18. The perimeter wall 18 includes a first end wall 22, a second end wall 24, a first lateral wall 26 and a second lateral wall 28. The housing 12 is elongated from the first end wall 22 to the second end wall 24 such that the housing has a length greater than 6.0 inches. The housing will typically have a width than 5.0 inches. In some embodiments, the housing will have a length being greater than 9.0 inches and less than 3.0 inches.

The top wall 16 has opaque areas 30 and translucent areas 32 such that light from an interior space 34 of the housing 12 is transmittable through the translucent areas 32. Though not essential, the translucent areas 32 may form a design or pattern in the top wall 16. For example, the translucent areas 32 may form an electricity pattern as shown in the Figures.

A plurality of power outlets 36 is mounted in the interior space 34 of the housing 12. The top wall 16 has a plurality of sets of apertures 38 extending therethrough and each of the apertures 38 is aligned with one of the power outlets 36 such that each of the power outlets 36 is accessible through the top wall 16. The power outlets 36 may comprise conventional two or three prong female power outlets. The power outlets 36 may be configured for different territorial laws regarding the types of prongs to be utilized. Additionally, the power outlets 36 may include USB type power outlets. The power outlets 36 may be aligned with each other such that at least four of the power outlets 36, each configured for receiving multiple prongs of a male power cord, are aligned along a line extending through the first 22 and second 24 ends. The power outlets 36 may also be arranged in two rows of four or more power outlets 36.

A power cord 40 extends outwardly from the housing 12 and terminates with a male power plug 42. The power cord 40 is pluggable into a conventional female power outlet. A power switch 44 is mounted on the housing 12 and is in electrical communication with the power outlets 36. The power switch 44 is actuated to power or un-power the power outlets 36. The assembly 10 may include additional features such as, in particular, power surge protection elements.

A plurality of light emitters 46 is mounted in the interior space 34 and is in electrical communication with the power switch 44 such that the light emitters 46 are turned on when power is provided to the power outlets 36. Each of the light emitters 46 comprises multi-color light emitter and in particular may comprise a conventional multi-color LED array. Each of the light emitters 46 is configured to selectively emit at least three different colors, though more colors may be provided either by including specifically colored LED elements or by combining LED elements of differing colors. Possible colors include red, green, blue, yellow, purple and orange. While light may also be provided. The light emitters 46 may be mounted on a light emitting strip 48 that is attached to the interior surface such that the light emitting strip extends around the interior space.

Alternatively, the light emitting strip 48 may include a plurality of light emitters 46 wherein each light emitter 46 is capable of emitting only a single color. In this embodiment, there may be one or more light emitters 46 each capable of producing a particular color. Thus, each color is produced by one or more light emitters 46.

A control circuit 50 is electrically coupled to the light emitters 46. The control circuit 50 is actuated to select one of a plurality of light emitting conditions. The light emitting conditions are defined as different colors and light patterns that may be chosen by the user of the assembly 10. For example, the conditions may include a steady first color condition comprising the light emitters 46 continuously emitting a steady first color, a steady second color condition comprising the light emitters continuously emitting a steady second color, and a steady third color condition comprising the light emitters continuously emitting a steady third color. Additional steady color conditions may be provided for each color for which the light emitters 46 are capable of producing. A variable lumen condition includes the light emitters 46 continuously emitting a selected one of the colors capable of being emitted by the light emitters 46, wherein the selected one of the colors is emitted with varying light intensity. That is, the light emitters 46 lighten and darken either randomly or in a pattern. An alternating color condition comprises the light emitters 46 cycling through the colors capable of being emitted by the light emitters 46. It should be understood that the light emitting conditions herein are only an example of the types of light emitting conditions that are possible.

A selection actuator 52 is mounted on the housing 12 and is in communication with the control circuit 50. The selection actuator 52 is actuated to select one of the light emitting conditions. The selection actuator 52 may comprise a single button wherein the selection actuator 52 is continuously pressed to cycle through each of the light emitting conditions. Alternate versions of the selection actuator may include multiple buttons, a selection dial or the like. Furthermore, the control circuit 50 may include a wireless connection capable of altering the light emitting condition by remote control. Each of the power switch 44 and selection actuator 52 may include translucent materials or sections such that each may be illuminated by the light emitters 46.

In use, the assembly 10 is used in a conventional manner for powering a plurality of electrical devices. However, the user of the assembly 10 can alter the appearance of the housing 12. The appearance can be used for aesthetic purposes or to allow the power strip assembly 10 to be matched to the colors of other devices being used in conjunction with the assembly 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A power strip assembly having multi-color light emitting capabilities, the assembly comprising:

a housing having a bottom wall, a top wall and a perimeter wall being attached to and extending between the top and bottom walls;

the top wall having opaque areas and translucent areas such that light from an interior space of the housing is transmittable through the translucent areas, wherein the translucent areas form an electricity pattern;

a plurality of power outlets being mounted in the interior space of the housing, the top wall haying a plurality of sets of apertures extending therethrough, each of the apertures being aligned with one of the power outlets such that each of the power outlets is accessible through the top wall;

a power cord extending outwardly from the housing and terminating with a male power plug;

a power switch being mounted on the housing, the power switch being in electrical communication with the power outlets;

a plurality of light emitters being mounted in the interior space and being in electrical communication with the power switch, each of the light emitters comprising multi-color light emitter, wherein each of the light emitters is configured to selectively emit at least three different colors;

a control circuit being electrically coupled to the light emitters, the control circuit being actuated to select a color emitted by the light emitters.

2. The power strip assembly according to claim 1, wherein the perimeter wall includes a first end wall, a second end wall, a first lateral wall and a second lateral wall, the housing being elongated from the first end to the second end, the power outlets being aligned with each other such that at least four of the power outlets are aligned along a line extending through the first and second ends.

3. The power strip assembly according to claim I, wherein the light emitters are mounted on a light emitting strip and attached to the interior surface such that the light emitting strip extends around the interior space.

4. The power strip assembly according to claim I, wherein the control circuit is actuated to select one of a plurality of light emitting conditions, the light emitting conditions including:

a steady first color condition comprising the light emitters continuously emitting a steady first color;

a steady second color condition comprising the light emitters continuously emitting a steady second color; and a steady third color condition comprising the light emitters continuously emitting a steady third color.

5. The power strip assembly according to claim 4, wherein the light emitting conditions include a variable lumen condition comprising the light emitters continuously emitting a selected one of the colors capable of being emitted by the light emitters, wherein the selected one of the colors is emitted with varying light intensity.

6. The power strip assembly according to claim 5, wherein the light emitting conditions include an alternating color condition comprising the light emitters cycling through the colors capable of being emitted by the light emitters.

7. The power strip assembly according to claim 4, wherein the light emitting conditions include an alternating color condition comprising the light emitters cycling through the colors capable of being emitted by the light emitters.

8. A power strip assembly having multi-color light emitting capabilities, the assembly comprising:

a housing having a bottom wall, a top wall and a perimeter wall being attached to and extending between the top and bottom walls;

the top wall having opaque areas and translucent areas such that light from an interior space of the housing is transmittable through the translucent areas, wherein the translucent areas form an electricity pattern;

a plurality of power outlets being mounted in the interior space of the housing, the top wall having a plurality of sets of apertures extending therethrough, each of the apertures being aligned with one of the power outlets such that each of the power outlets is accessible through the top wall;

a power cord extending outwardly from the housing and terminating with a male power plug;

a power switch being mounted on the housing, the power switch being in electrical communication with the power outlets;

a plurality of light emitters being mounted in the interior space and being in electrical communication with the power switch, said light emitters being configured to selectively produce one of a plurality of colors to be transmitted through said translucent areas, wherein said plurality of colors includes at least three different colors;

a control circuit being electrically coupled to the light emitters, the control circuit being actuated to select a color emitted by the light emitters.

9. The power strip assembly according to claim 8, wherein the perimeter wall includes a first end wall, a second end wall, a first lateral wall and a second lateral wall, the housing being elongated from the first end to the second end, the power outlets being aligned with each other such that at. least. four of the power outlets are aligned along a line extending through the first and second ends.

10. The power strip assembly according to claim 8, wherein the light emitters are mounted on a light emitting strip and attached to the interior surface such that the light emitting strip extends around the interior space.

11. The power strip assembly according to claim 8, wherein the control circuit is actuated to select one of a plurality of light emitting conditions, the light emitting conditions including:

a steady first color condition comprising the light emitters continuously emitting a steady first color;

a steady second color condition comprising the light emitters continuously emitting a steady second color; and a steady third color condition comprising the light emitters continuously emitting a steady third color.

12. The power strip assembly according to claim 11, wherein the light emitting conditions include a variable lumen condition comprising the light emitters continuously emitting a selected one of the colors capable of being emitted by the light emitters, wherein the selected one of the colors is emitted with varying light intensity.

13. The power strip assembly according to claim 12, wherein the light emitting conditions include an alternating color condition comprising the light emitters cycling through the colors capable of being emitted by the light emitters.

14. The power strip assembly according to claim 11, wherein the light emitting conditions include an alternating color condition comprising the light emitters cycling through the colors capable of being emitted by the light emitters.

15. A power strip assembly having multi-color light emitting capabilities, the assembly comprising:

a housing having a bottom wall, a top wall and a perimeter wall being attached to and extending between the top and bottom walls, the perimeter wall having an interior surface facing an area bounded by the perimeter wall, the perimeter wall including a first end wall, a second end wall, a first lateral wall and a second lateral wall;

the top wall having opaque areas and translucent areas such that light from an interior space of the housing is transmittable through the translucent areas, the translucent areas forming an electricity pattern;

a plurality of power outlets being mounted in the interior space of the housing, the top wall having a plurality of sets of apertures extending therethrough, each of the apertures being aligned with one of the power outlets such that each of the power outlets is accessible through the top wall;

a power cord extending outwardly from the housing and terminating with a male power plug;

a power switch being mounted on the housing, the power switch being in electrical communication with the power outlets;

a plurality of light emitters being mounted in the interior space and being in electrical communication with the power switch, each of the light emitters comprising multi-color light emitter, wherein each of the light emitters is configured to selectively emit at least three different colors, the light emitters being mounted on a light emitting strip and attached to the interior surface such that the light emitting strip extends around the interior space;

a control circuit being electrically coupled to the light emitters, the control circuit being actuated to select one of a plurality of light emitting conditions, the light emitting conditions including:

a steady first color condition comprising the light emitters continuously emitting a steady first color;

a steady second color condition comprising the light emitters continuously emitting a steady second color;

a steady third color condition comprising the light emitters continuously emitting a steady third color;

a variable lumen condition comprising the light emitters continuously emitting a selected one of the colors capable of being emitted by the light emitters, wherein the selected one of the colors is emitted with varying light intensity;

an alternating color condition comprising the light emitters cycling through the colors capable of being emitted by the light emitters;

a selection actuator being mounted on the housing and being in communication with the control circuit, the selection actuator being actuated to select one of the light emitting conditions;

the housing being elongated from the first end to the second end; and the power outlets being aligned with each other such that at least four of the power outlets are aligned along a line extending through the first and second ends.

* * * * *